United States Patent [19]

Eden et al.

[11] Patent Number: 4,853,168

[45] Date of Patent: Aug. 1, 1989

[54] PROCESS FOR SPINNING STARCH FIBERS

[75] Inventors: James Eden, East Millstone; Ralph M. Trksak, Manville, both of N.J.

[73] Assignee: National Starch and Chemical Corporation, Bridgewater, N.J.

[21] Appl. No.: 137,485

[22] Filed: Dec. 23, 1987

[51] Int. Cl.[4] ..... D01F 9/00

[52] U.S. Cl. ..... 264/180; 106/210; 162/175; 264/179; 264/186; 264/211; 264/211.11; 264/211.14

[58] Field of Search ..... 264/186, 180, 179, 178 F, 264/211.11, 211.14, 211; 106/210, 213, 214; 162/157.6, 175

[56] References Cited

U.S. PATENT DOCUMENTS

| | | | |
|---|---|---|---|
| 2,369,847 | 12/1941 | Olsen et al. | 99/140 |
| 2,809,895 | 7/1955 | Swisher | 99/140 |
| 2,902,336 | 9/1959 | Hiemstra | 18/54 |
| 3,030,667 | 4/1962 | Kunz | 18/57 |
| 3,041,180 | 10/1957 | Swisher | 99/140 |
| 3,116,351 | 12/1963 | Wohlrabe | 264/186 |
| 3,336,429 | 8/1967 | Carevic | 264/186 |
| 3,499,962 | 8/1967 | Wurzburg et al. | 424/35 |
| 3,514,298 | 3/1968 | Nozmick et al. | 99/123 |
| 3,786,123 | 1/1971 | Katzen | 264/53 |
| 3,922,354 | 11/1975 | Galluzzi et al. | 426/96 |
| 3,971,852 | 7/1976 | Bremmer et al. | 426/103 |
| 4,139,699 | 2/1979 | Hernandez et al. | 536/109 |
| 4,230,687 | 10/1980 | Sair et al. | 424/22 |
| 4,242,364 | 12/1980 | Buddemeyer et al. | 426/613 X |
| 4,243,480 | 1/1981 | Hermandez | 162/141 |
| 4,276,312 | 6/1981 | Merritt | 426/96 |
| 4,277,364 | 7/1981 | Shasha et al. | 252/316 |
| 4,331,689 | 5/1982 | Shemwell | 426/103 X |
| 4,344,857 | 8/1982 | Shasha et al. | 252/316 |
| 4,382,813 | 5/1983 | Shasha | 71/88 |
| 4,439,488 | 3/1984 | Trimnell | 428/402.24 |
| 4,657,582 | 4/1987 | Huber | 71/121 |

FOREIGN PATENT DOCUMENTS

| | | |
|---|---|---|
| 0145846 | 8/1984 | European Pat. Off. . |
| 1072795 | 6/1967 | United Kingdom . |

*Primary Examiner*—Hubert Lorin

*Attorney, Agent, or Firm*—Ellen T. Dec; Edwin M. Szala

[57] ABSTRACT

Raw starch is slurried in an aqueous solution containing up to and above saturation levels of an ammonium sulfate, ammonium monobasic or dibasic phosphate, sodium sulfate or mixtures thereof. The slurry is then cooked at temperatures above about 150° C. The resulting starch cook is then extruded using conventional methods into a coagulating salt bath thereby producing a starch fiber. When the starch is cooked in the presence of a salt prior to spinning in the coagulation bath, dilution of the salt in the coagulation bath is minimized, thus reducing the evaporation load.

8 Claims, No Drawings

PROCESS FOR SPINNING STARCH FIBERS

U.S. Pat. Nos. 4,139,699 issued Feb. 13, 1979 to Hernandez et al. and 4,243,480 issued June 6, 1981 to Hernandez et al. as well as U.S. Pats. Nos. 2,902,336 issued Sept. 1, 1959 to Heimstra et al; 3,030,667 issued Apr. 24, 1962 to Kung; 3,116,351 issued Dec. 13, 1963 to Wohbrabe et al. and 3,336,429 issued Aug. 15, 1967 to Carevic teach methods for the formation of starch fibers by spinning or extruding a heat or chemically stabilized starch solution into an aqueous coagulation salt bath.

We have now found that if the starch is cooked in the presence of a salt prior to spinning in the coagulation bath, dilution of the salt in the coagulation bath is minimized, thus reducing the evaporation load and consequently lowering the initial capital cost of the evaporation as well as the operating costs over those required by the method of the prior art.

Thus, the present invention is directed to an improved method for the production of starch fibers. In accordance with the invention, raw starch is slurried in an aqueous solution containing up to and above saturation levels of an ammonium sulfate, ammonium monobasic or dibasic phosphate, ammonium sulfamate, sodium sulfate or mixtures thereof. The slurry is then cooked at temperatures sufficient to cook the starch in the presence of the salt (normally above about 150° C. for a neutral pH slurry of starch and salt). The resulting starch cook is then extruded using conventional methods into a coagulating salt bath thereby producing a starch fiber.

The process of the invention is not limited to any specific starch. Corn starch, rice starch, potato starch, tapioca starch, wheat starch, amylose or amylopectin fractions may be employed. The starch base may be used in modified or unmodified form. The choice of the starch to be used is dependent in large part on the end use of the starch fiber. If desired, water soluble hydrocolloids such as polyvinyl alcohol, carboxymethylcellulose, hydroxyethylcellulose, polyacrylic acid and polyvinyl pyrrolidinone may replace up to 50% of the starch component. The starch may be present in the starch slurry in amount of 5 to 40% by weight of the solids (starch plus salt).

The salt may be present in the starch slurry in the amount of 1 to 130 weight percent on water; higher levels, as they would not increase the soluble concentration of salt at the jet cooking temperatures, may be used but give no additional improvement. The optimum level is that which yields a saturated salt solution at the temperature used in jet cooking the starch slurry. Thus, it may be desirable to add the salt in an amount which, at room temperature may result in undissolved crystalline salt in the saturated solution, the latter being dissolved in the saturated solution at the elevated temperatures employed. Since the principal advantage of the present invention is to eliminate the necessity for evaporation of large quantities of water, the preferred salt level is that which yields, on exiting the jet cooker, a concentration identical to that of the salt coagulation bath. Under optimum conditions, the amount of salt in the slurry and in the coagulation bath should be approximately equal. The reason for this is to allow the combined waters of the coagulation bath and jet cook (fibers removed) to be used to slurry up more starch without the need for additional salt.

Depending on the starch base utilized as well as the method of coagulation, it may also be desireable to incorporate in the starch slurry sodium hydroxide, potassium hydroxide or ammonium hydroxide. These alkali stabilizing materials may be used if magnesium or sodium salts are utilized. However, in the case of ammonium salts, which must be utilized at pH levels of 8 or below, the addition of alkali is not desired and indeed, it may be necessary to add an acidic material in order to obtain the required pH.

The resultant slurry is then cooked using, for example, a pressure retort or steam injection to form a colloidal dispersion of the starch. While the colloidal dispersion with some starches or at low salt concentrations may be cooled to room temperature, it is preferred to utilize the starch at elevated temperatures so as to maintain the colloidal dispersion and insure efficient fiber precipitation.

The coagulating bath used in preparing the starch fibers according to the present invention comprises an aqueous solution containing specific salts selected from the group consisting of ammonium sulfate, ammonium sulfamate, mono- and di-basic ammonium phosphate, sodium sulfate and mixtures thereof. It is preferred that the same salt used in the coagulation bath is also employed in the starch slurry.

It is also possible to combine the above mentioned functional salts used in the starch slurry and/or the coagulation bath with other compatible salts which may accelerate the formation of, improve the processing of, or produce some other desired result on the starch fibers formed. Suitable salts for this purpose include ammonium persulfate, ammonium carbonate, ammonium bromide, ammonium bisulfite, ammonium nitrite, ammonium nitrate, ammonium bicarbonate, ammonium oxalate, sodium, and potassium chloride, potassium sulfate, among others. Generally no advantage is seen in using these additional salts since the primary sulfate, sulfamate or phosphate salts must still be present in their respective minimum amount in order to effect coagulation.

The actual fiber spinning techniques including the composition of the coagulating bath may be any of those utilized in the prior art as exemplified by the previously identified U.S. Patents. Examplary of these is the bath described in U.S. Pat. No. 4,139,699. In this case, the coagulating bath comprises an aqueous solution containing specific ammonium salts selected from the group consisting of ammonium sulfate, ammonium sulfamate, mono- and dibasic ammonium phosphate and mixtures thereof. The minimum concentraion of the salt required to effect coagulation as well as the preferred salt or salt blend will vary depending upon the particular starch base employed. For example, in the case of waxy maize starch, it is necessary for ammonium sulfate to be present in amounts of at least 35%, by weight of the total solution, ammonium sulfamate 72% (saturation), dibasic ammonium phosphate 37% and monobasic ammonium phosphate 40%. In the case of corn starch or similar starches containing about 64–80% amylopectin, lower concentrations of salt may be used with ammonium sulfate required in amounts of 20%, ammonium sulfamate 50%, mono-basic ammonium phosphate 25% and di-basic ammonium phosphate 30%. In the case of hybrid corn starches containing less than about 50% amylopectin, ammonium sulfate must be present in amounts of at least 15%, ammonium sulfamate 40% di-basic ammonium phosphate 25% and mono-basic ammonium phosphate 20%. While sodium sulfate may be used in the case of higher amylose starches, the other salts discussed herein are preferred for use with other starch bases.

An added feature of the present invention is the fact that most of the salt present in the colloidal dispersion remains in the coagulating bath thereby substantially reducing the need for frequent replenishment of the salt in the coagulation bath.

Starch fibers can be produced at any temperature at which the starch dispersion can be handled. Generally, the coagulation bath is maintained at about room temperature (20° C.) during production of the fibers, however, higher temperatures may be desired under certain condition since they increase the solubility of the salt in the coagulating bath resulting in more concentrated solutions. Conversely, with some low amylose starches a cool salt bath decreases the time required to develop a tack-free fiber suitable for removal by filtration.

In preparing the starch fibers, the starch dispersion is introduced continuously or by dops in the form of a thread-like stream into a moving coagulating salt solution. This introduction may be accomplished either from above or below the salt solution using any conventional techniques. Thus, the dispersion may be extruded through an apparatus containing at least one aperture, such as a spinnerette, a syring or a biuret feed tube. Alternatively, the dispersion may be discharged under pressure from a pipe or tube containing a plurality of apertures into a surrounding enclosed area, e.g. a concentric pipe, containing the moving coagulating solution. Various adaptations of the above and related techniques may be used and the fibers may thus produced using either batch or continuous operations.

Depending upon the desired end use of the fibers, the method of recovery thereof may vary. Thus, the aqueous suspension or slurry of fibers may be used directly, such as by introducing it into a paper stream, thereby enabling complete integration of the fiber production into the paper manufacturing plant. The fibers may also be recovered in the dry state for example, by collecting the fibers from water on a screen or similar device. It is then preferable to reslurry the fibers into a nonaqueous solvent such as methanol, ethanol, isopropanol, acetone or the like in which the fibers are not soluble. The fibers are then recovered, as by filtration, from the solvent and dried. Other methods such as centrifuging, flash-drying or spray-drying may also be used to remove the water. Once dried, the fibers may be re-introduced into an aqueous medium and will exhibit excellent re-dispersibility maintaining their discrete, discontinuous structure. Alternatively, the fibers may be recovered from the slurry, as by filtration, washed and placed in water at levels of up to about 50% solids and formed into "wet slabs" for subsequent use.

It will be recognized that the techniques described herein are adaptable to a wide range of coagulating techniques as well as a variety of fiber types. Thus, depending upon the starch base and/or the processing technique, the fibers may be water-sensitive or water insensitive; further, they may comprise only starch, a starch-hydrocolloid blend, or a fiber containing water-insoluble additives. Post-reaction of the starch fibers with various starch derivatizing agents or conventional cross-linking agents is also possible.

The invention is illustrated further by the following examples which are not, however, intended to limit the scope of the invention. Unless otherwise stated, all parts in the examples are by weight.

EXAMPLE

Starch fiber was prepared from 40 fluidity corn starch (Flogel 40 from National Starch and Chemical Corp.) using the techniques described in U.S. Pat. No. 4,138,699. The raw starch was slurried at 31.7 percent solids in water, jet cooked by live steam injection, and spun, under 40 psi, through a die having 91 holes each of 11 mil diameter. A precipitating salt bath of 37.6 percent solids ammonium sulfate was pumped past the die at a rate of 8 gallons per minute. The resulting slurry of starch fiber in salt solution was collected, the percentage of each component determined, and a mass balance for the spinning process calculated. This is shown in Table IA.

To re-concentrate the salt solution in the output stream to the original precipitating bath strength, so that it may be recycled, requires evaporation of the waters added with the starch slurry and as steam.

The rate of generation of this water, expressed as mass over time; divided by the rate of fiber produced, expressed as mass over time, is defined as the evaporator load. These values are also shown in Table IA.

TABLE 1A

| Salt Bath In | | Starch Slurry In | | Steam In | Salt Bath & Fiber Out | | |
|---|---|---|---|---|---|---|---|
| Salt | Water | Starch | Water | Water | Starch | Salt | Water |
| 359 g | 595.7 g | 7.1 g | 15.3 g | 20 g | 7.1 g | 359 g | 630 g |

Evaporator load 5.0g water/g starch fiber produced

A second bath of starch fiber was made according to the present invention using a raw starch slurry containing salt. The precipitating bath concentrations and flows were identical the previous run. Equipment used was identical. Cooking conditions and feed pressure were also identical. For this run, the raw starch slurry consisted of the 40 fluidity corn starch, ammonium sulfate, and water in proportions such that the starch to total slurry weight ratio was similar to that used above and that the salt to water ratio was similar to that in the precipitating bath. As before, the output stream was collected and a mass balance calculated for this one pass spinning process.

TABLE 1B

| Salt Bath In | | Starch Slurry In | | | Steam In | Salt Bath & Fiber Out | | |
|---|---|---|---|---|---|---|---|---|
| Salt | Water | Starch | Salt | Water | Water | Starch | Salt | Water |
| 356 g | 590.8 g | 11 g | 8.4 g | 15.8 g | 20 g | 11 g | 364.4 g | 626 g |

Evaporator load 2.0g water/g starch fiber

Comparison of the mass balances shows that inclusion of the salt in the raw starch slurry has substantially reduced the evaporator load required to maintain a constant salt concentration.

EXAMPLE 2

Starch fiber was made using high amylose starch (Hylon 7 from National Starch and Chemical Corp.).

The starch was slurried in water at 30 percent solids, jet cooked at 300° F. and spun under 40 psi, into 25.4 percent solids ammonium sulfate solution through a die having 91 holes of 11 mil diameter. The precipitating salt bath was pumped past the die at a rate of 8 gallons per minute.

The resulting slurry of starch fiber in salt solution was collected, the percentage of each component determined, and a mass balance for the spinning process calculated. This is shown in Table 2A.

TABLE 2A

| Salt Bath In | | Starch Slurry In | | Steam In | Salt Bath & Fiber Out | | |
|---|---|---|---|---|---|---|---|
| Salt | Water | Starch | Water | Water | Starch | Salt | Water |
| 238 g | 700 g | 4.6 g | 10.8 g | 20 g | 4.6 g | 238 g | 757.4 g |

Evaporator load 12.5g water/g starch fiber.

Starch fiber was made using identical equipment, precipitating bath concentrations and flows. In this case the raw starch slurry contained ammonium sulfate at a concentration, on water, equal to the precipitating bath. The ratio of total slurry weight was similar to the case above without salt.

The output stream was analyzed and a mass balance calculated for the spinning process as shown in Table 2B.

TABLE 2B

| Salt Bath In | | Starch Slurry In | | | Steam In | Salt Bath & Fiber Out | | |
|---|---|---|---|---|---|---|---|---|
| Salt | Water | Starch | Salt | Water | Water | Starch | Salt | Water |
| 247.5 g | 730 g | 6.1 g | 3.7 g | 11.5 g | 20 g | 6.1 g | 251.2 g | 761.5 g |

Evaporator load 3.4 g water/g starch fiber

Again it can be seen that the inclusion of salt in the raw slurry has substantially reduced the evaporator load required to maintain a constant salt concentration in the precipitating bath.

Similar results would be obtained using other salts, starches and/or spinning procedures as known to those skilled in the art.

Now that the preferred embodiments of the present invention have been described in detail, various modifications and improvements thereon will become readily apparent to those skilled in the art. Accordingly the spirit and scope of the invention are to be limited only by the appended claims and not by the foregoing specifications.

We claim:

1. In a method for the production of starch fibers wherein a stabilized colloidal dispersion of starch is extruded into a moving coagulating salt bath containing a salt selected from the group consisting of ammonium sulfate, ammonium sulfamate, mono-basic ammonium phosphate, di-basic ammonium phosphate, sodium sulfate and mixtures thereof, the improvement which comprises adding 1 to 130% by weight of a salt selected from the group consisting of ammonium sulfate, ammonium sulfamate, ammonium monobasic or dibasic phosphate, sodium sulfate and mixtures thereof, to an aqueous starch slurry; and cooking the starch slurry to form the colloidal dispersion of starch.

2. The method of claim 1 wherein the same salt is used in the starch slurry as is present in the coagulation bath.

3. The method of claim 1 wherein a saturated solution of salt is used in the starch slurry.

4. The method of claim 1 wherein there is additionally present in the starch slurry a salt selected from the group consisting of ammonium persulfate, ammonium carbonate, ammonium bromide, ammonium bisulfate, ammonium nitrate, ammonium bicarbonate, ammonium oxalate, sodium chloride, potassium chloride and potassium sulfate.

5. The method of claim 1 wherein the salt used is ammonium sulfate.

6. The method of claim 1 wherein the starch is corn starch.

7. The method of claim 1 wherein the starch is a high amylose starch.

8. The method of claim 3 wherein the starch slurry additionally contains undissolved salt.

* * * * *